US005402304A

United States Patent [19]

Smith

[11] Patent Number: 5,402,304

[45] Date of Patent: Mar. 28, 1995

[54] STATIC ELIMINATOR AIR ENHANCEMENT DEVICE

[76] Inventor: Dirk S. Smith, 6678 Hollandaire Dr. West, Boca Raton, Fla. 33433

[21] Appl. No.: 19,214

[22] Filed: Feb. 18, 1993

[51] Int. Cl.[6] ..... H05F 3/06; B65H 3/48

[52] U.S. Cl. ..... 361/214; 361/213; 271/105

[58] Field of Search ..... 271/97, 98, 105, 106; 361/212, 213, 214, 215, 220, 226, 230, 231

[56] References Cited

U.S. PATENT DOCUMENTS

| | | | |
|---|---|---|---|
| 937,759 | 10/1909 | Blake | 361/220 |
| 1,251,173 | 12/1917 | Beregh, Jr. | 361/214 X |
| 3,083,011 | 3/1963 | Saul | 271/105 |
| 3,123,641 | 3/1964 | Longley | 361/212 X |
| 3,617,049 | 11/1971 | Testone | 271/105 |
| 3,984,731 | 10/1976 | Martin | 361/212 |
| 4,676,915 | 6/1987 | Steltenkamp et al. | 252/8.8 |
| 4,714,559 | 12/1987 | Steltenkamp et al. | 252/8.8 |
| 5,040,264 | 8/1991 | Bryant | 15/339 |
| 5,095,400 | 3/1992 | Saito | 361/220 |

FOREIGN PATENT DOCUMENTS

| | | | |
|---|---|---|---|
| 61-23050 | 1/1986 | Japan | 271/105 |

*Primary Examiner*—A. D. Pellinen
*Assistant Examiner*—Fritz M. Fleminy
*Attorney, Agent, or Firm*—Malin, Haley, DiMaggio & Crosby

[57] ABSTRACT

An apparatus used in eliminating static buildup in paper (or plastic) stock used within paper handling machines, wherein an anti-static air enhancer cartridge is inserted in an airstream. The airstream passes across the enhancer cartridge where positively charged ions are released into the airstream. The enhanced airstream is then directed at the top sheet of paper stock which is to be fed into the printing press. The positively charged particulates in the airstream act to neutralize the charged static charges which build up between sheets in the stock. This allows the top sheet to be easily separated from the stock, preventing paper jams and misfeeds. The device can be used with existing paper feed mechanisms that use an air supply under pressure to separate stock sheets, such as printing presses, paper collators, paper folding machines, paper sheeters, web presses, sheeters, and thermography machines, or plastic stock feeding machines.

6 Claims, 2 Drawing Sheets

STATIC ELIMINATOR AIR ENHANCEMENT DEVICE

BACKGROUND OF THE INVENTION

1. Field of the Invention

The present invention relates generally to the elimination of static electric charges on paper stock used within paper printing press machines, paper folding machines, paper collators, and other types of paper handling machines. More particularly, the invention relates to an apparatus and method which includes an air charge enhancement device to electrically charge air flowing in an air stream directed at statically charged paper stock used within these machines to discharge the paper stock.

2. Description of the Prior Art

In order to run a successful printing business and be competitive, it is essential to operate high capacity and high speed printing presses, collators and folders. The rate or speed of printing a high quality product can be significantly reduced by paper jams occurring within these machines. This type of problem most often presents itself when paper is fed into the machine and each sheet sticks together due to static electric charges building up due to friction between the sheet surfaces. Two sheets often stick together with two or more sheets then being fed into the printing press, resulting in a paper jam. This results in unwanted down time when the press is not operational. Since equipment can only run as fast as the paper will feed, it is necessary to eliminate as much static as possible between sheets of paper in the stack as they are fed into the machine. This elimination process tends to prevent these burdensome paper jams and misfeeds and the associated press "downtime."

All paper develops some electrical attraction between sheets to a varying degree. In particular, glossy heavyweight paper, used most often for magazines and brochures, is particularly troublesome. Since paper is an insulator and poor conductive material, any static charge which builds up between paper sheets tends to remain fixed on each sheet because it is not conducted away. The paper then exhibits characteristics similar to oppositely polarized magnets in which each sheet of a different polarity sticks or is attached together. A stream of air, in conjunction with a suction device, has most often been used to mechanically separate stock sheets for feeding within these machines. The top sheet is separated from the remaining paper stock, and is fed into the machine. The top sheet is separated by directing a stream of air from an air source to the side or front of the top sheet of paper stock. The airstream is of such a velocity that the air is directed between the top sheet and the remaining stock below. Each sheet often resists being separated because of the electrical attraction to the oppositely charged sheet below it. When a suction device attached to the machine attempts to lift and mechanically separate the top sheet for insertion into the machine, the attractive electrical force results in two or more sheets actually being inserted. This misfeed results in a jam because the machine detects the presence of more than one sheet and automatically shuts down.

As the paper begins to adhere or stick together, the machine must be slowed down. The stock must be continuously jogged and re-jogged or a compressor must be continuously used to blow the sheets apart from their side or back. In printing presses, typically, $8\frac{1}{2}\times11$ carbonless sheets must be run one up on the A. B. Dick 360 instead of two up $11\times17$. Also, if using coated stock, smaller loads must be used in order to prevent sheet compression. Heavyweight carbonless stock must be used instead of the lightweight paper in order to prevent each sheet sticking due to the static electricity buildup. Overall, this means wasted time, slower press speeds, varying quality due to starts and stops, and small jobs taking much longer than necessary.

Many different techniques have been used to eliminate this type of static buildup in paper. These include the use of liquid sprays, tinsels, electric ionizers, nuclear ion cartridges, as well as re-trimming of the paper. None of these prior techniques have efficiently or consistently eliminated the static buildup problem.

SUMMARY OF THE INVENTION

The present invention provides a method and apparatus for neutralizing the static charges which build up on paper stock within a printing press, paper thermography machines, paper web presses, paper collators, folders, and other types of paper handling machines. The invention provides a quick and inexpensive method and apparatus to discharge static electricity on paper stock in order to allow the press to operate at a more rapid and efficient speed.

An apparatus according to a first aspect of the invention includes a cylindrically-shaped housing having inlet and outlet openings with a hollow interior portion. An air electric charge enhancer, anti-static cartridge is mounted within the housing. Separate inlet and outlet air hose fittings are then secured to opposite ends of the housing and are attached in a manner to provide a substantially airtight enclosure, fully enclosing the air charge enhancement cartridge. The housing containing the air enhancement cartridge is inserted in-line between an air source providing an air stream under pressure, and the existing air stream line at the paper feed stations in the printing press. The air source supplies a continuous source of clean air at a fixed rate. As air passes across the air charge enhancement cartridge, minute amounts of positively charged particulate matter are released, ionizing the air stream. This enhanced or charged air then exits the cylindrical housing and is directed at the top sheets of paper stock within the press. The top sheets are taken in seriatim, next in line, for insertion into the machine.

According to another aspect of the invention, a method is provided for neutralizing static charges on paper stock within a paper printing press by engulfing the paper stock with oppositely charged air. The method includes supplying air from an air source to the printing press in order to separate the top sheet from the paper stock. An air charge enhancement device is inserted in the air stream between the air source and the press. The air charge enhancement device operates by passing an air stream over material with a large surface area having positively charged particulate matter thereon. The air stream ionizes as air contacts the cartridge inside a housing. The unique chemical composition of an anti-static air enhancement cartridge within the device allows a limited number of positive charges to be released from the material as the air stream passes across the treated surface of the cartridge. These positive charges travel through an output air supply line where they are directed to the top sheets of paper stock within a press. The positively charged ionic particles act to neutralize any negative charges on the paper, either on the top sheet or any sheets below in the paper stock. This allows the top sheet to be easily separated by a suction device used within the press so the top sheet of paper may be easily and rapidly separated from the stack and inserted into the printing press.

The air charge enhancer includes a multi-sided body having a predetermined surface area that may be formed from any rigid material, such as a non-porous, woven polyester or paper. An example would be a device that is shaped like a star in a cross section, having five separate sides, projecting radially from a central axis providing ten surfaces. The exterior of the body is coated with a cationic quaternary ammonium compound, containing a rheological additive, all of which completely coats the rigid framework of the non-porous, woven material. Other representative chemicals include quaternary ammonium compounds and amines, dialkyl dimethel ammonium chlorides, quarternary imidazolinium salts. Examples of a rheological additive would be smectite type clay, and hydrophilic laponite clay. The longitudinal axis of the star shaped, multi-sided enhancer is aligned axially with an axis formed between the input aperture and the output aperture of the cylindrical housing so that input air is directed over all ten surfaces of the enhancer, allowing for maximum charge accumulation on the air flowing over the surface prior to its exiting out the output. A pair of hoses connects each end, which has a protruding circular input and a protruding circular output that are formed as part of the cylindrical, hollow housing for easy attachment of small air-carrying hoses at each end.

Although the primary objective is to use the present invention with glossy paper used in printing, it has also been determined that the invention can also be used with other printing paper grades used in offset printing which also becomes statically charged at times, causing the paper to stick together. The invention has been found to be an effective anti-static device for other static generating material sheets, such as plastic, to expedite separating in the feed of plastic sheets seriatim in a machine from a stack of sheets. The invention may be used other environments where it is desirous to be rid of static electricity.

It is an object of this invention to provide a static electricity eliminator, especially useful for printing operations for reducing or eliminating static charge on paper that is to be used in printing.

It is another object of this invention to provide an anti-static eliminator that can provide charged air in a variety of environments that reduces static electricity on surrounding objects.

And yet still another object of this invention is to provide a static electricity eliminator that can be readily attached to existing printing equipment in the airstream to reduce or eliminate static electricity on paper stock that will be used in printing.

These and other objects, advantages, and features of this invention will become apparent upon review of the following specification in conjunction with the drawings. The drawings constitute a part of this specification and include example embodiments of the present invention and illustrate various objects and features thereof.

DESCRIPTION OF THE PREFERRED EMBODIMENTS

Figures 1, 2:
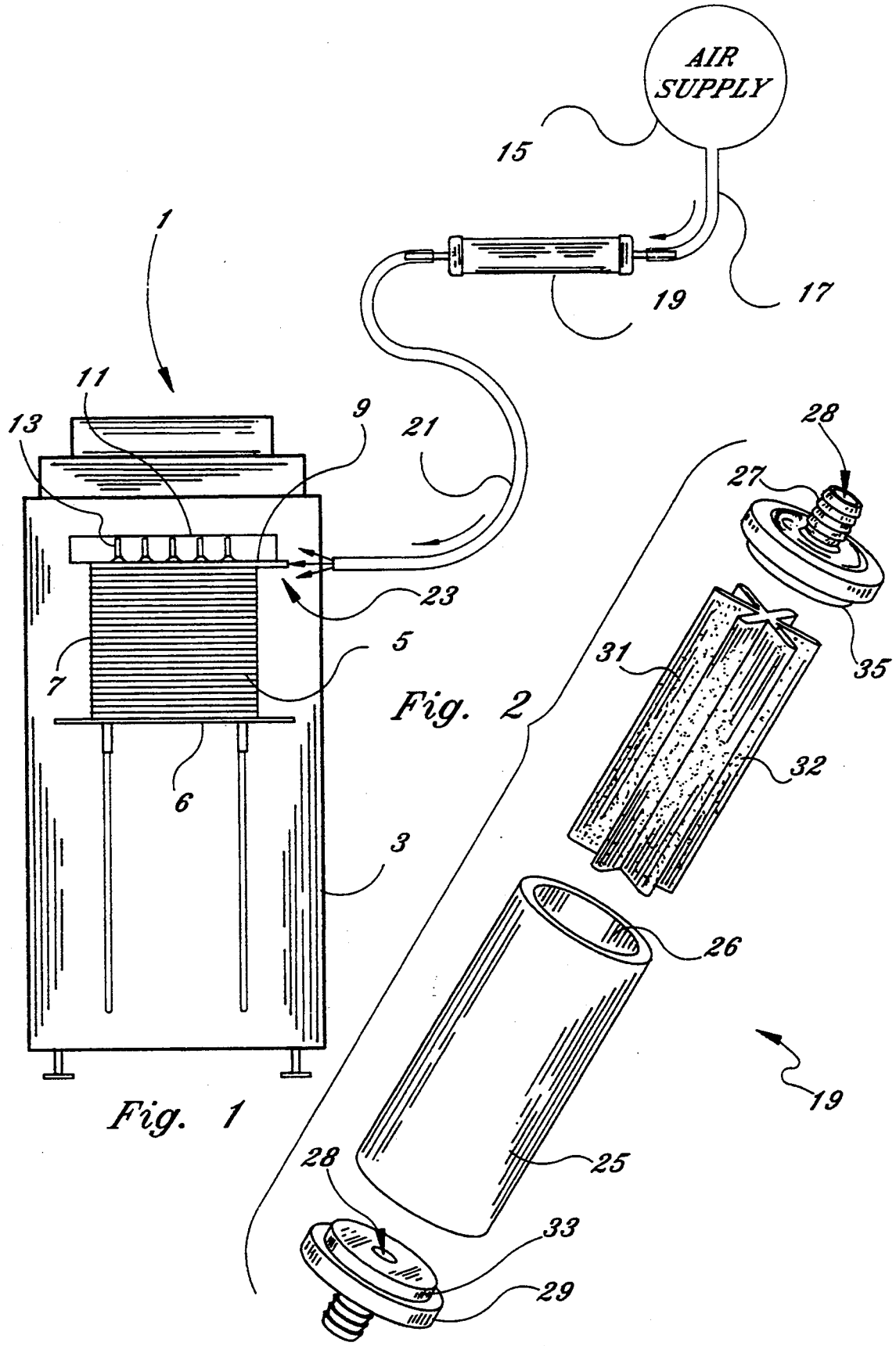
FIG. 1 is a perspective view of the overall printing system, including printing press, air supply, and air enhancer apparatus.
FIG. 2 is a side exploded view of the air enhancer apparatus.

Referring now specifically to the drawings, and the illustrative embodiments depicted therein, a printing and static eliminator system generally shown at 1 includes a high speed printing press 3, an air supply source 15, and an air enhancement device 19 in accordance with the invention.

Typical examples of the printing press 3 include the A. B. Dick 360 and the Miller 4-Color 40 inch Perfecter. Within the press 3, a paper stock 5 is pushed or forced in an upward direction by paper feeder 6. The top sheet 7 of paper from the stock 5 is raised through the use of a suction device 11. Suction device 11 includes suction feet 13 which lifts each top paper sheet 7 into a raised position 9, where it is inserted into the press for printing. This type of process is typical of most high speed and high volume printing press machines.

Each top sheet of paper is removed from the stock in seriatim until the entire paper stock is depleted. The paper stock may be of any type with varying sizes, thicknesses, or textures. Glossy stock is especially troublesome with static charges causing sheets to stick together.

An air charge enhancement device 19 is inserted between air supply 15 which supplies air above atmospheric pressure to printing press 3. Air flows from the supply 15 through an input air supply line 17 through an air charge enhancement device 19, where the charged air is then directed through output air supply tube or line 21. Both input supply line 17 and output supply line 21 are standard hoses and may be of various sizes or lengths. Output air supply line 21 is typically positioned so as the enhanced or charged air exits the end of the output air supply line and is subsequently directed towards the top sheet 7 of paper stock 5. Preferably, this air is directed toward the upper sheets and dispersed over as much of the top sheet upper and lower surface area as possible in addition to the sheet directly below the top sheet.

As shown in FIG. 2, an exploded view of enhancement device 19 comprises a rigid, preferably plastic, cylindrically-shaped housing 25 with a hollow interior 26 and an anti-static air charge enhancement cartridge 31 which slides longitudinally into the hollow interior 26 of external housing 25 where it engages the sides of the hollow interior. Air hose connectors 27 and 29 having air transporter channels 28 disposed therethrough are connected at opposite ends of external housing 25. The recessed lips 33 and 35 of air hose connectors 29 and 27, respectively, fit tightly within the inner diameter of the hollow interior 26 so as to provide a substantially air tight seal around the perimeter of the fitting.

The multi-walled, cross-sectional star shape of the anti-static air removable and replaceable enhancement cartridge 31 was selected to provide several elongated surfaces having a large amount of total surface area for air, from supply source 15, to contact as the air passes through air enhancement device 19. The amount of charge received in the air traversing housing 25 is a direct function of the surface area of cartridge 31. Any shape of the cartridge is possible however, and would depend on the particular anti-static requirements of each situation. Enhancement device 19 operates in a manner such that when air is forced unidirectionally through air transporter channel 28, at either end of the device, the air passes across and contacts the surfaces 32 of anti-static air enhancement cartridge 31. Enhancer cartridge 31 is coated with a material so that extremely small amounts of particulate matter physically transfer an electrical charge from the surfaces 32 of the material into the airstream passing over and across the cartridge 31. The material contains excess charges (believed to be electrons). The amount of air flow necessary from air supply 15 and the surface area of enhancer cartridge 31 will depend on each particular application. Typical amounts used in the A. B. Dick 360 are 15 cubic feet per minute of air flow with the total surface area of the enhancer cartridge 31 being 40 square inches. This assumes an enhancement cartridge 31 with five panels, each panel having the dimensions 4 inches × 1 inch. Air supply 15 may also be regulated in order to provide a fixed volume of air passing across the cartridge 31. These two factors also determine the life expectancy of air enhancement cartridge 31, but a typical life span is 1,000 hours, using the airflow parameters set forth above.

The material of air enhancement cartridge 31 is manufactured using first a somewhat rigid frame of a non-porous, woven, spin bound material, such as polyester, formed in a rigid, star-shaped body having five panels. The frame material is then coated with a cationic quaternary ammonium amines, in conjunction with a bentonite thickener. The cationic quaternary ammonium amine acts to provide positively charged ions into the airstream while the bentonite thickener mixed thoroughly therein is a rheological additive which thickens the mixture to prevent melting. This unique condition provides an even distribution of charged ions and even wear, so as melting and chunking of the material is prevented. In particular, the geometrical configuration may be altered, as long as it is appreciated that an elongated body having sufficient surface area to provide for a sufficient charge transfer to the airstream is presented. The particular configuration shown in FIG. 2 is especially suited for use in a cylindrical chamber with axial inlet and outlet openings which are connected to the air supply at one end and provide for air exhaust at the other end of the cylindrical housing so that the air transverses completely the complete longitudinal axis of the cylindrical housing and the cartridge itself. It is believed that the more time that the air flow passes over the surface are, there is additional charge received into the airstream. Therefore, the flow rate is also a factor to be considered through the cylindrical housing over the cartridge. The air enhancement cartridge 31 is typically manufactured anywhere between 2 and 24 inches long. Four inches is a standard size. Additionally, if more charge is required, two or more enhancement devices may be linked in series to provide an even greater amount of ions to the airstream.

Figure 3:
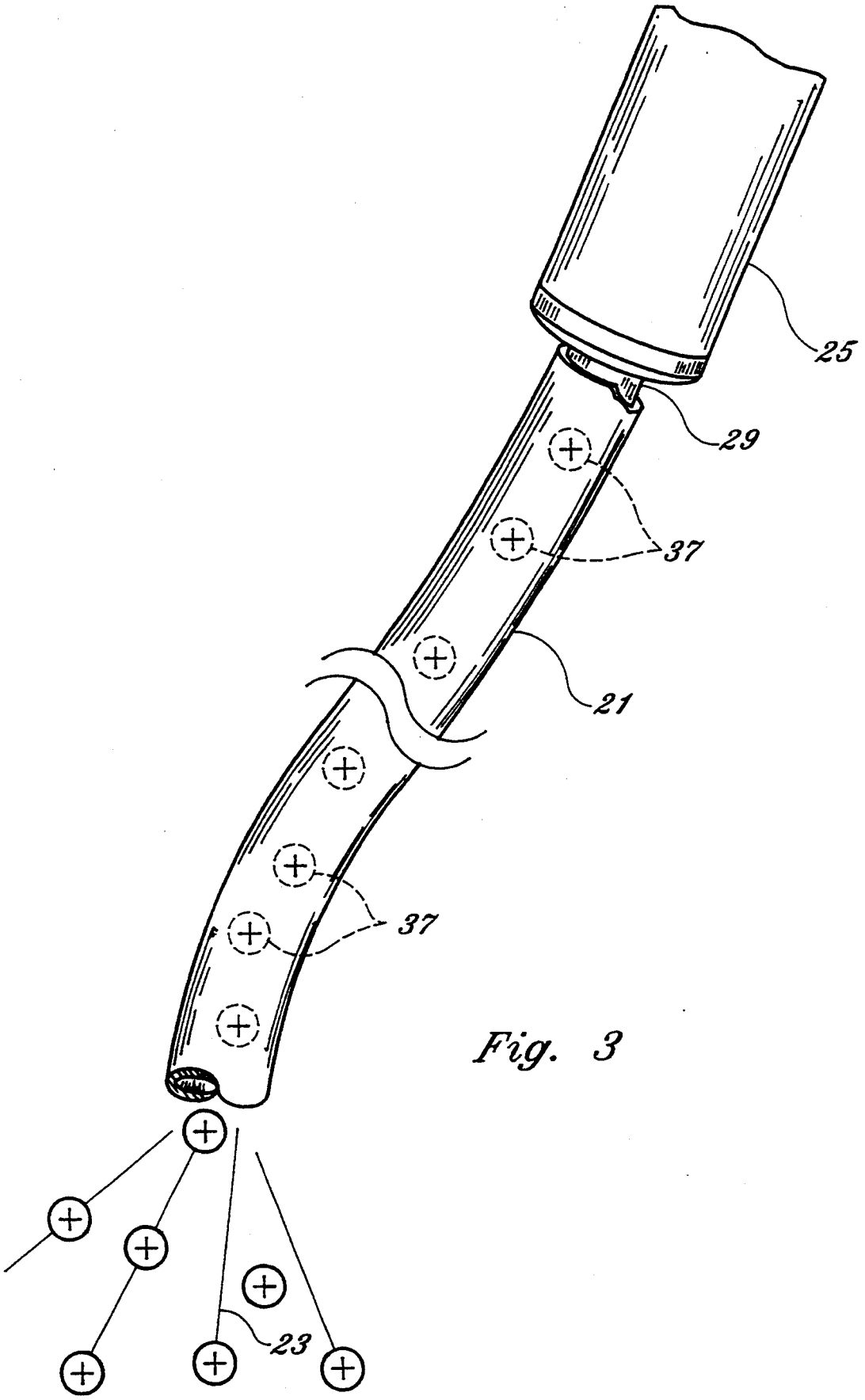
FIG. 3 is a side exaggerated view of negatively charged ions moving through the output supply line.

As described above, as the airstream passes over enhancer cartridge 31, the air is enhanced with charged ions and small particulate matter. FIG. 3 depicts the movement of particulate matter 37 through output air supply line 21 for direction into the printing press 3 and specifically, at the top paper sheet 7 and the sheet below the top sheet. The enhanced air stream 23 disperses enhanced air across top paper sheet 7, allowing the positively charged particulates within the air stream to interact and neutralize the negatively charged upper and lower surfaces of top paper sheet 7 and the other sheets in stock 5. Accordingly, top paper sheet 7 then becomes neutrally charged, allowing suction device 11 and suction feet 13 to easily pick up top sheet 7 and insert it into the printing press 3. In certain instances, it is possible that other sheets in the paper stock 5 will become similarly charged. In that case, top paper sheet 7 will actually be repelled away from the other sheets in the stock, making it an easy task for suction device 11 to attach itself to the top paper sheet.

Utilizing air enhancement device 19 and the associated method described herein provides a device and method for neutralizing static electric charges on the paper stock within a printing press. Many different types of paper stock may now be quickly fed into a printing press, avoiding numerous paper jams and misfeeds and associated downtime.

Although the apparatus and method are primarily directed to printing presses, paper folders, collators, and sheeters, application of this invention is also within the scope of photocopying or photofaxing and could be used anywhere large amounts of paper are fed from a stack into a machine for processing of some sort. Plastic sheets can also be treated using the invention to expedite feeding from a stack.

It is to be understood that while a certain form of the invention is described herein, the scope of the invention is not limited to only the specific form and arrangement described. It will be apparent to those skilled in the art that various changes may be made without departing from the scope of the invention and the invention is not considered limited to what is shown in the drawings or described in the specification.

What is claimed and desired to be secured by Letters Patent of the United States is:

1. An apparatus connectable in-line to an existing air source conduit, said air source conduit supplying a stream of air under pressure used to separate individual paper stock sheets, said apparatus enhancing the air stream to reduce static charges on the stock sheets to prevent the stock sheets from clinging together, said apparatus comprising:

a housing having an air inlet opening and an air outlet opening connectable in line to an existing air source conduit, said housing having a hollow interior for receiving an air stream; and a removable anti-static air enhancing, air contacting cartridge mounted within said housing to contact said air stream received in said housing, said cartridge comprising a chemical anti-static composition of cationic quaternary amines and a thickener;

such that when an air stream is forced through said air inlet opening, air flows in contact with said cartridge, ionizing said air stream, whereby the ionized air is directed through said air outlet opening and is subsequently directed toward the stock sheets.

2. An apparatus as recited in claim 1, wherein said cartridge is a multi-sided body having a predetermined surface area.

3. An apparatus as recited in claim 2, wherein said cartridge is star-shaped in cross section, having five separate sides projecting radially from a central longitudinal axis, thereby providing ten surfaces for said air stream to contact.

4. An apparatus connectable in-line to an existing air source conduit, said air source conduit supplying a stream of air used to separate individual paper stock sheets, said apparatus enhancing the air source to reduce static charges on the stock sheets to prevent the stock sheets from clinging together, said apparatus comprising:

a housing, said housing having a hollow interior;

a removable closure hermetically attachable to said housing for allowing access to the interior of said housing;

an inlet air passage in fluid communication with said housing interior;

an outlet air passage in fluid communication with said housing interior;

a first air tube fitting connected to said inlet air passage for attaching said inlet air passage to an air supply tube;

a second air tube fitting connected to said outlet air passage for attaching said outlet air passage to an air supply tube; and a removable anti-static air enhancing, air contacting cartridge mounted within said housing, said cartridge comprising a chemical anti-static composition of cationic quaternary amines and a thickener;

such that when an air stream is forced through said air inlet passage, air flows across said cartridge contacting said cartridge, ionizing said air stream, whereby the ionized air is directed through said air outlet passage and is subsequently directed toward the stock sheets.

5. An apparatus as recited in claim 4, wherein said cartridge is a multi-sided body having a predetermined surface area.

6. An apparatus as recited in claim 5, wherein said cartridge is star-shaped in cross section, having five separate sides projecting radially from a central longitudinal axis, thereby providing ten surfaces for said air stream to pass over.

* * * * *